US005371777A

United States Patent [19]

Koehler et al.

[11] Patent Number: 5,371,777

[45] Date of Patent: Dec. 6, 1994

[54] AUTOMATIC X-RAY EXPOSURE UNIT FOR MAMMOGRAPHY

[75] Inventors: Karlheinz Koehler, Herzogenaurach; Horst Aichinger, Fuerth, both of Germany

[73] Assignee: Siemens Aktiengesellschaft, Munich, Germany

[21] Appl. No.: 60,529

[22] Filed: May 13, 1993

[30] Foreign Application Priority Data

Jul. 10, 1992 [DE] Germany ..... 4222775
Nov. 23, 1992 [DE] Germany ..... 4239309

[51] Int. Cl.[5] ..... H05G 1/42

[52] U.S. Cl. ..... 378/108; 378/97; 378/207

[58] Field of Search ..... 378/108, 98, 97, 109, 378/110, 117, 114, 207

[56] References Cited

U.S. PATENT DOCUMENTS

| | | | |
|---|---|---|---|
| 4,638,500 | 1/1987 | Smits et al. | 378/207 X |
| 4,748,648 | 5/1988 | Boucle et al. | 378/108 X |
| 4,763,343 | 8/1988 | Yanaki . | |
| 5,166,969 | 11/1992 | Heidsieck | 378/207 |
| 5,218,625 | 6/1993 | Heidsieck | 378/108 X |

FOREIGN PATENT DOCUMENTS 3008261 9/1981 Germany .

*Primary Examiner*—David P. Porta
*Attorney, Agent, or Firm*—Hill, Steadman & Simpson

[57] ABSTRACT

An automatic x-ray exposure unit for mammography permits a correction of the mAs product dependent on the subject thickness without the need for obtaining a transparency signal, and thus without the need for the double detector normally needed for that purpose. The automatic x-ray exposure unit permits the correction to be undertaken on site, prior to conducting an actual examination, and thus can be used for film/foil systems, such as customized systems for which no previous transparency data has been obtained. This is accomplished in an automatic x-ray exposure unit where the mAs product is obtained for a fraction (1/n) of the total exposure, and a total exposure value is then obtained by multiplying the fractional value by n. These values are used to generate a characteristic curve, which is stored, for the film/foil system being used. If it is then necessary to switch (adjust) the mAs value due to the subject thickness, this can be done using the stored curve.

3 Claims, 2 Drawing Sheets

AUTOMATIC X-RAY EXPOSURE UNIT FOR MAMMOGRAPHY

BACKGROUND OF THE INVENTION

1. Field of the Invention

The present invention is directed to an automatic x-ray exposure unit suitable for use in mammographic examinations, which adjust the radiation dose, as defined by the mAs product, based on the particular film-/foil system being employed and based on the patient thickness.

2. Description of the Prior Art

Several factors enter into the degree of blackening (exposure) of x-ray film in the production of x-ray images. For most types of examinations, including mammographic examinations, an optimum balance must be achieved in order to provide a readable exposed image, with the blackening being sufficiently dark to identify the details of the image, but not so dark that background blackening obscures those details. It is therefore known to automatically control the radiation dose in an x-ray diagnostics installation in order to achieve the desired degree of exposure of the x-ray film. Such adjustment is generally not a continuous, analog-type of adjustment, but rather constitutes a switching between one or more constant dose rates. Preferably other exposure parameters, such as tube voltage and current and the pre-filtering are not altered, i.e., the adjustment takes place independently of those parameters. The adjustment is necessary in order to take into account differing patient thicknesses. A given film/foil system, for example, may produce optimum blackening with a particular dose (mAs product) for a patient of nominal thickness, but may produce less than optimum results for a patient exhibiting a greater thickness. It is known to obtain a correction value, for use in adjusting the dose, based on the thickness of the subject by means of a double detector. Such a double detector obtains a value known as a transparency measurement, and is composed of two measurement cells, with the cell which is more remote from the x-ray source "seeing" radiation pre-filtered with a brass filter. Given a known tube voltage and a known prefiltering, the quotient of the two signals from the respective cells is thus dependent on the thickness of the subject, and can be employed for correcting the nominal dose value which has been set.

Leaving the possibility that the sensitivity of the detector cells themselves may be slightly energy-dependent, the measurements obtained by such a double detector are dependent not only on the examination subject, but also on the particular cassette and foil which are being used.

A basic curve 1 is shown in FIG. 1 for the mAs product dependent on the subject thickness, given a constant radiation dose at a measuring detector for a kV value. As noted above, the blackening decreases with increasing subject thickness.

In order to obtain a constant blackening (exposure level) at the film which is, of course, disposed behind the subject in the direction of radiation propagation, the mAs product must be corrected in a suitable manner, i.e., a higher mAs product must be provided, by switching the dose, given an increasing subject thickness.

For this purpose, a corrected characteristic curve 2 of the type shown in FIG. 2 is obtained for commonly used, commercially available film/foil systems, the corrected curve 2 being dependent on the nature of the film/foil system itself, the tube voltage and the pre-filtering.

In FIG. 2, the line 3 represents the calculated or nominal mAs value, the line 4 represents the amount of correction, and the line 5 represents the corrected mAs value, read from the corrected curve 2.

Given a constant pre-filtering, therefore, a characteristic curve must be calculated dependent on the tube voltage and on the particular film/foil system being used. This characteristic curve can be mensurationally calculated for all standard film/foil systems, and it is known to store such calculated curves in an automatic exposure unit. When a given, known film/foil system is used, the particular stored curve for that system, already calculated, is simply called from the memory and is used to undertake any necessary corrections.

Such correction curves, however, are only stored for film/foil systems which have already been tested, and thus a specific film development made for a customer, i.e., a customized film/foil system, will not have a stored curve associated therewith.

SUMMARY OF THE INVENTION

It is an object of the present invention to provide a method for generating a characteristic curve on site for an "unknown" or new film/foil system.

It is a further object of the present invention to provide an automatic x-ray exposure unit which makes use of such an on site-obtained curve.

It is a further object of the present invention to provide such a method and automatic x-ray exposure unit wherein a correction on the subject thickness ensues without the need for acquiring a transparency signal, i.e., without the need to use a known double detector.

The above objects are achieved in a method and apparatus wherein, with an "unknown" film/foil system in place, the mAs product is obtained for a fraction (1/n) of the total exposure, and a total exposure value is then obtained by multiplying the fractional value by n. These values, and possibly a few other values obtained at different fractions of the total exposure, are supplied to a computer, which interpolates the values between the measured values to generate a characteristic curve for the film/foil system being used. This curve is then entered into a memory, and can be used in the manner described above to undertake corrections in the mAs product, as may be needed due to differing patient thicknesses.

DESCRIPTION OF THE PREFERRED EMBODIMENTS

Figure 1:
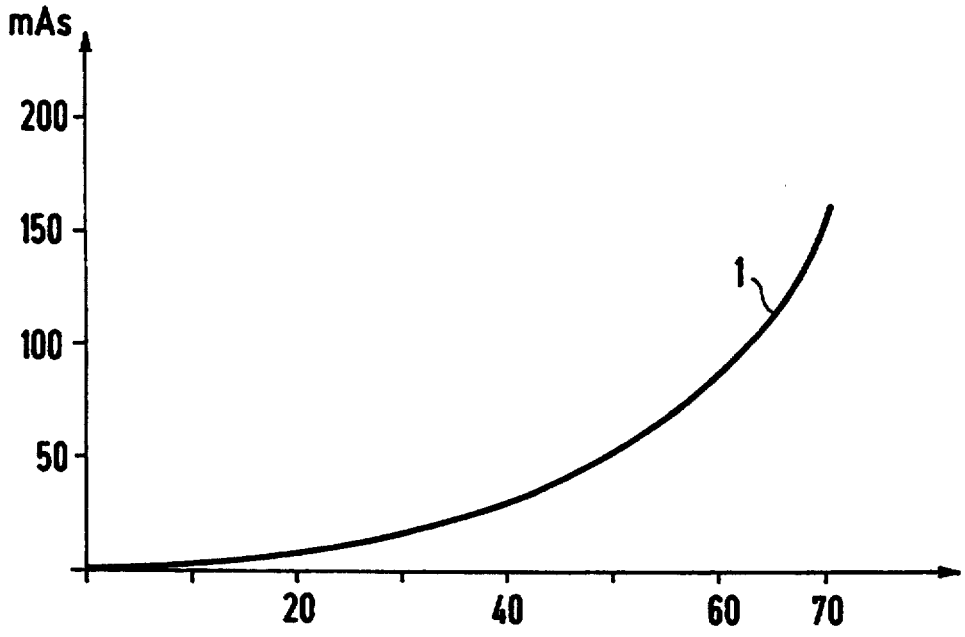
FIG. 1, as noted above, shows a basic curve for the mAs product dependent on subject thickness.
Figure 2:
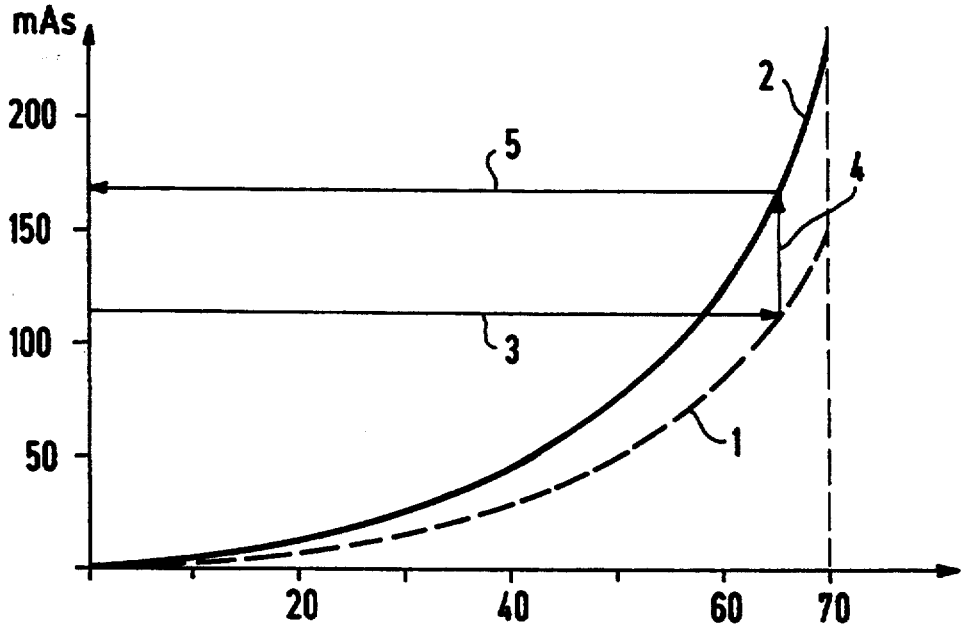
FIG. 2, as noted above, explains the standard manner by which a correction in the mAs product is undertaken, given a known film/foil system.

The method and apparatus of the invention permit a correction in the mAs product to be undertaken in the manner described above in connection with FIG. 2, but provide the necessary data on site for generating the corrected curve 2, for an "unknown" film/foil system, i.e., a film/foil system for which a characteristic curve has not been previously calculated, or supplied by the manufacturer. Such an automatic x-ray exposure unit is shown in FIG. 3.

Figure 3:
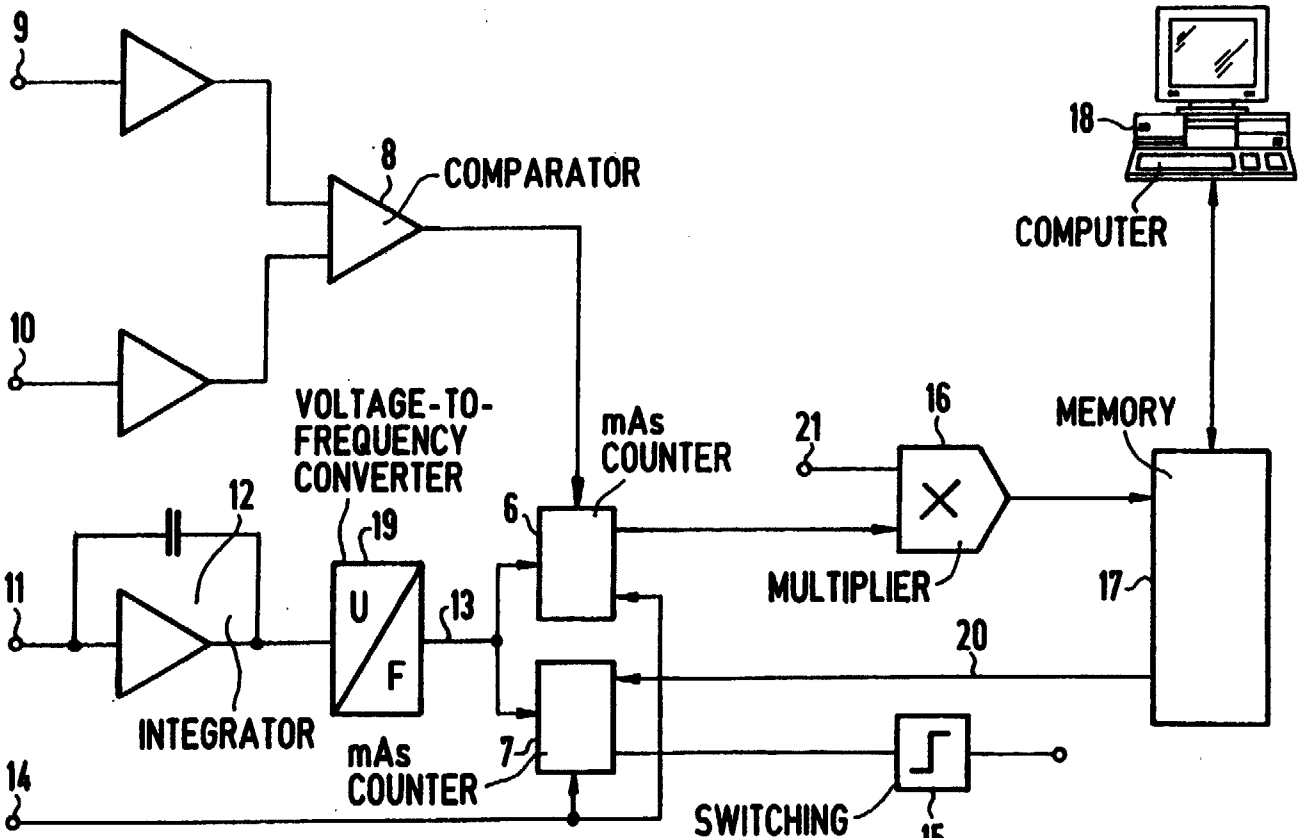
FIG. 3 is a schematic block diagram of an automatic x-ray exposure unit constructed in accordance with the principles of the present invention, for undertaking a correction of the type shown in FIG. 2 with an "unknown" film/foil system.

The unit shown in FIG. 3 has two mAs counters 6 and 7. The mAs counter 6 is driven by the output of a comparator 8, which receives a fraction 1/n times the nominal dose value at its input 9, and which receives a signal corresponding to the actual dose value, obtained in a known manner, at its input 10. A signal corresponding to the x-ray tube current is supplied to input 11, and is integrated by an integrator 12. This d.c. voltage signal is converted into a pulsed signal having a frequency proportional to the d.c. level in a voltage-to-frequency converter 19. The converted signal is supplied to the inputs of the counters 6 end 7 on line 13.

An enabling/reset signal is supplied to the counters 6 and 7 at the beginning of an exposure on line 14.

The output signal of the counter 6 is supplied to a multiplier 16, which multiplies the output from the counter 6 by a factor n, to obtain a total exposure value. The multiplier 16 can be switched by an input 21 to multiply the output of the counter 6 by one, i.e., to directly pass the output of the counter 6 through the multiplier 16, so that both the fractional value and the total value are supplied to a memory 17. Based on these values, a computer 18, connected to the memory 17, interpolates the intervening values so as to obtain a curve, comparable to the curve 2 shown in FIG. 2, for the "unknown" film/foil system. Using this curve, a corrected mAs value is obtained via the computer 18 for a given patient thickness, and is supplied via the memory 17 to the mAs counter 7. When the count of the counter 7 reaches this corrected value, the counter 7 supplies an output signal to a switching stage 15, which switches the radiation dose as needed. The fraction of the total exposure which causes the comparator 8 to supply the signal to the counter 6 which stops the counter 6 from counting, may be, for example 25% of the total exposure.

The memory 17 may be the memory which is used, as described earlier, for the purpose of storing the characteristic curves for a number of standard film/foil systems, in addition to its use as part of the automatic exposure unit described herein.

Although modifications and changes may be suggested by those skilled in the art, it is the intention of the inventors to embody within the patent warranted hereon all changes and modifications as reasonably and properly come within the scope of their contribution to the art.

We claim as our invention:

1. An automatic exposure unit for use in a mammography installation having an x-ray source which supplies an x-ray dose measurable in mAs units and a film/foil system for recording an x-ray image of a subject, said automatic exposure unit comprising:

means for multiplying said mAs value for a selected fraction of an exposure by the reciprocal of said fraction to obtain a total exposure value;

means for extrapolating a characteristic mAs curve for said film/foil system based at least on said mAs value for a selected fraction of an exposure and said total exposure value; and means for switching said dose to adjust for thickness of said subject using a corrected value obtained from said characteristic curve.

2. An automatic exposure unit for use in a mammography installation having an x-ray source which supplies an x-ray dose measurable in mAs units and a film/foil system for recording an x-ray exposure of a subject, said automatic exposure unit comprising:

first counter means for generating a count corresponding to a measured mAs value during an exposure;

second counter means for generating a count corresponding to said measured mAs value during an exposure;

means for stopping counting of said first counter means when a selected fraction of a total exposure is reached, said first counter means thereby stopping counting at a fractional count;

means for multiplying said fractional count by the reciprocal of said fraction to obtain a total exposure value;

means for generating a characteristic mAs/subject thickness curve at least from said fractional count and said total exposure value;

means for obtaining a corrected value for adjusting said mAs value based on the thickness of said subject, said corrected value being supplied to said second counter means; and means connected to an output of said second counter means for switching said x-ray dose when said count of said second counter reaches said corrected value.

3. A method for automatically controlling an x-ray exposure in a mammography installation having an x-ray source which supplies an x-ray dose measurable in mAs units and a film/foil system for recording an x-ray exposure, said method comprising the steps of:

acquiring a signal corresponding to an mAs value for a selected fraction of an exposure;

generating a total exposure value by multiplying said mAs value for a selected fraction of an exposure by the reciprocal of said fraction;

extrapolating a characteristic mAs curve for said film/foil system based at least on said mAs value for a fraction of said exposure and said total exposure value; and switching said dose rate to adjust for thickness of said subject using a corrected value obtained from said characteristic curve.

* * * * *